US009062894B2

(12) United States Patent
Miyazaki

(10) Patent No.: US 9,062,894 B2
(45) Date of Patent: Jun. 23, 2015

(54) FLUID HEATING DEVICE

(75) Inventor: Hiroaki Miyazaki, Hiratsuka (JP)

(73) Assignee: KELK Ltd., Kanagawa (JP)

( * ) Notice: Subject to any disclaimer, the term of this patent is extended or adjusted under 35 U.S.C. 154(b) by 280 days.

(21) Appl. No.: 13/203,791

(22) PCT Filed: Mar. 18, 2010

(86) PCT No.: PCT/JP2010/054681

§ 371 (c)(1),
(2), (4) Date: Aug. 29, 2011

(87) PCT Pub. No.: WO2010/110171

PCT Pub. Date: Sep. 30, 2010

(65) Prior Publication Data

US 2012/0014679 A1 Jan. 19, 2012

(30) Foreign Application Priority Data

Mar. 24, 2009 (JP) ..... 2009-072501

(51) Int. Cl.
*A45D 20/40* (2006.01)
*F26B 3/30* (2006.01)
(Continued)

(52) U.S. Cl.
CPC *F24H 1/142* (2013.01); *F28D 7/12* (2013.01); *F28F 9/22* (2013.01); *F28F 21/006* (2013.01); *F28F 2009/224* (2013.01)

(58) Field of Classification Search
CPC ..... F28F 21/006; F28F 9/22; F28F 2009/224; F24H 1/142; F28D 7/12; H05B 2203/032; H05B 3/44; H05B 3/009; H05B 3/145; F24C 7/043; A45D 20/40
USPC ..... 392/407, 480, 483, 465, 466; 165/156, 165/154

See application file for complete search history.

(56) References Cited

U.S. PATENT DOCUMENTS 3,167,066 A * 1/1965 Hughes ..... 122/18.31
3,519,255 A * 7/1970 Cooper ..... 432/30
(Continued)

FOREIGN PATENT DOCUMENTS

JP 10-209125 8/1998
JP 10-259955 9/1998
(Continued)

OTHER PUBLICATIONS

International Search Report issued Apr. 20, 2010 in International (PCT) Application No. PCT/JP2010/054681.
(Continued)

*Primary Examiner* — Sang Y Paik
*Assistant Examiner* — Gyounghyun Bae
(74) *Attorney, Agent, or Firm* — Wenderoth, Lind & Ponack, L.L.P.

(57) ABSTRACT

A fluid heating device for heating chemicals mainly containing sulfuric acid, which is capable of suppressing reduction of heating efficiency even if a fluid mainly containing sulfuric acid is heated, includes a translucent inner tube composed of quartz or the like, a lamp heater disposed in the inner tube, a translucent outer tube disposed outside the inner tube, which is composed of quartz or the like, translucent side plates disposed on both sides of the outer tube, which include quartz or the like, and an amorphous carbon pipe disposed between the outer tube and the inner tube, which functions as a light-absorbing material, wherein the amorphous carbon pipe is disposed so as to be brought into contact with chemicals passing through a space between the outer tube and the inner tube.

2 Claims, 6 Drawing Sheets

(a)

(b)

(51) Int. Cl.

| | |
|---|---|
| ***F21V 7/00*** | (2006.01) |
| ***G02B 17/00*** | (2006.01) |
| ***F24H 1/14*** | (2006.01) |
| ***F28D 7/12*** | (2006.01) |
| ***F28F 9/22*** | (2006.01) |
| ***F28F 21/00*** | (2006.01) |

(56) References Cited

U.S. PATENT DOCUMENTS

| | | | | |
|---|---|---|---|---|
| 4,533,820 | A * | 8/1985 | Shimizu | 219/411 |
| 4,550,245 | A * | 10/1985 | Arai et al. | 219/405 |
| 4,914,276 | A * | 4/1990 | Blair | 219/390 |
| 4,968,871 | A * | 11/1990 | Hamrin | 392/422 |
| 5,559,924 | A * | 9/1996 | Kadotani et al. | 392/483 |
| 5,790,752 | A * | 8/1998 | Anglin et al. | 392/483 |
| 6,157,778 | A * | 12/2000 | Kadotani | 392/483 |
| 6,236,810 | B1 * | 5/2001 | Kadotani | 392/485 |
| 6,621,984 | B2 * | 9/2003 | Castaneda et al. | 392/483 |
| 6,687,456 | B1 * | 2/2004 | Woo et al. | 392/424 |
| 7,015,437 | B2 * | 3/2006 | Johnston et al. | 219/653 |
| 7,153,285 | B2 * | 12/2006 | Lauman et al. | 604/6.08 |
| 7,164,104 | B2 * | 1/2007 | Lin | 219/543 |
| 7,593,625 | B2 * | 9/2009 | Kamikawa et al. | 392/393 |
| 7,668,444 | B2 * | 2/2010 | Tsai | 392/407 |

FOREIGN PATENT DOCUMENTS

| | | |
|---|---|---|
| JP | 2000-111156 | 4/2000 |
| JP | 2000-227253 | 8/2000 |
| JP | 3310559 | 8/2002 |
| JP | 3847469 | 11/2006 |
| JP | 2007-101048 | 4/2007 |
| JP | 2008-138905 | 6/2008 |

OTHER PUBLICATIONS

Office Action issued Jul. 30, 2013 in corresponding Japanese Application No. 2009-072501, with partial English translation.

* cited by examiner (a)

(b)

(a)

(b)

(a)

(b)

FLUID HEATING DEVICE

TECHNICAL FIELD

The present invention relates to a fluid heating device, and the like, and particularly to a fluid heating device capable of suppressing the reduction of a heating efficiency even if a sulfuric acid-based fluid is heated.

BACKGROUND ART

In an RCA washing step in which semiconductor wafers are washed, foreign substances attached to a semiconductor wafer are removed by using chemicals. In the RCA washing step, the chemicals to be used varies depending on the treatment. For example, when particles attached to a semiconductor wafer are removed, an ammonium hydroxide/hydrogen peroxide mixture is used; whereas when metal ions attached to a semiconductor wafer are removed, a hydrochloric acid/hydrogen peroxide mixture is used. When the semiconductor wafers are washed with the chemicals such as the ammonium hydroxide/hydrogen peroxide mixture or hydrochloric acid/hydrogen peroxide mixture, it is necessary to raise the temperature of the chemicals used for washing to, for example, approximately 80° C.

Conventionally, for controlling the temperature of the chemicals, the chemicals are heated by using a fluid heating device, thereby raising the temperature of the chemicals. The fluid heating device heats the chemicals by using, for example, a lamp heater such as a halogen lamp and by bringing a quartz glass tube into contact with the chemicals while electric current is applied to the lamp heater that has been put into the quartz glass tube, thereby heating the solution (see, for example, Patent Document 1).

When the lamp heater (the halogen lamp) is used as a heat source and the intended chemicals described above are treated in the fluid heating device, radiation (emission) performs 90% or more of heating. In addition, because the radiation heating can have a very high heating capacity per unit area, it is possible to make the device smaller.

PRIOR ART TECHNICAL DOCUMENT

Patent Document 1

[Patent Document 1] Japanese Patent No. 3847469 (paragraphs 0019 to 0029)

SUMMARY OF THE INVENTION

Problems to be Solved by the Invention

However, when the fluid to be heated is sulfuric acid or is a sulfuric acid-based fluid, it has properties such that the rate of absorption of the near-infrared rays emitted from a halogen lamp is low (60 to 70% in a case of sulfuric acid). For that reason, when the sulfuric acid-based chemicals are heated by using a conventional fluid heating device, 30% to 40% of light energy that is transmitted through a quartz glass tube and the chemicals are directly absorbed into a heat-insulating material, which is provided outside the chemicals, and much of the heat energy thereof is released outward; as a result, a temperature of a case of the fluid heating device is raised or the temperature of the solution may not reach a desired temperature. In other words, there is a problem in which the heating efficiency of the fluid heating device is reduced.

The present invention has been made in consideration of the situations described above, and the object of the present invention is to provide a fluid heating device capable of suppressing reduction of a heating efficiency even if a fluid mainly containing sulfuric acid is heated.

Means for Solving the Problem

In order to solve the problem described above, a fluid heating device according to one aspect of the present invention is a fluid heating device for heating chemicals mainly containing sulfuric acid, including a translucent inner tube; a lamp heater disposed in the inner tube; a translucent outer tube disposed outside the inner tube; a translucent side plates disposed on both sides of the outer tube; and a light-absorbing material disposed between the outer tube and the inner tube, wherein the light-absorbing material is disposed so as to be brought into contact with chemicals passing through a space between the outer tube and the inner tube.

According to the fluid heating device described above, when the light-absorbing material is disposed between the inner tube and the outer tube, convection-heating and conduction-heating can be promoted. More particularly, even if a fluid mainly containing sulfuric acid is heated, reduction of a heating efficiency can be suppressed, because the light energy is absorbed in the light-absorbing material and is converted into heat energy, and the conduction-heating heats the chemicals.

Also, in a fluid heating device according to one aspect of the present invention, it is possible that the inner tube, the outer tube and the side plates are each made of quartz, and the inner tube and the outer tube are each connected to the side plates by welding to integrally form. This enables the risk of leakage of the chemicals to be reduced.

Also, in a fluid heating device according to one aspect of the present invention, it is preferable that the light-absorbing material forms a passage for the chemicals passing through a space between the outer tube and the inner tube.

Effect of the Invention

According to the present invention, a fluid heating device capable of suppressing reduction of a heating efficiency can be provided, even if a fluid mainly containing sulfuric acid is heated.

DETAILED DESCRIPTION OF THE INVENTION

Referring to Figures, a first embodiment of the present invention will be explained below.

Figure 1:
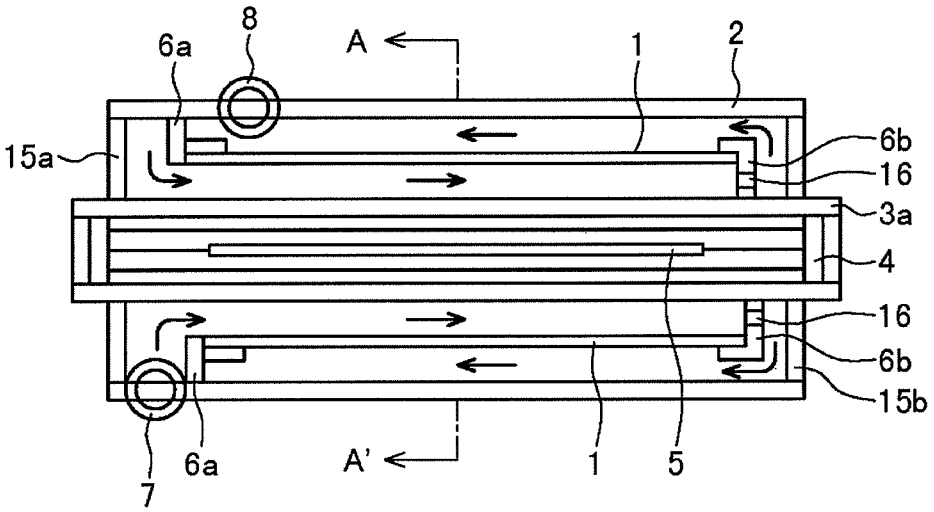
FIG. 1 (*a*) is a schematic view showing a longitudinal section of a fluid heating device according to a first embodiment of the present invention; and (*b*) is a cross-sectional view corresponding to A-A' line in (a).
Figure 1:
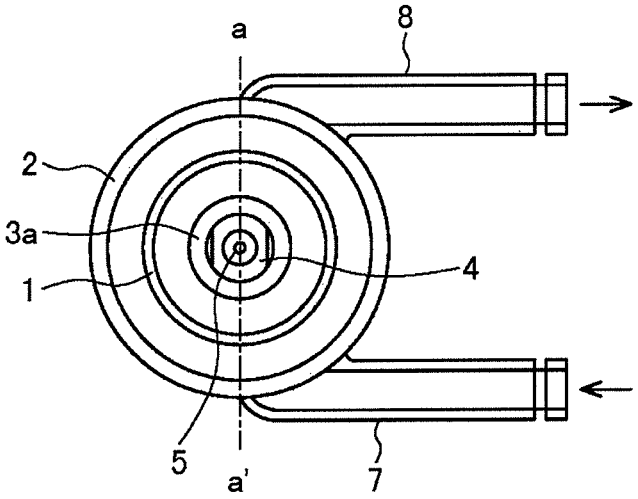

FIG. 1 shows schematic views showing a fluid heating device according to a first embodiment of the present invention, in which FIG. 1 (*b*) is a cross-sectional view corresponding to A-A' line in FIG. 1 (*a*), and FIG. 1 (*a*) is a longitudinal cross-sectional view corresponding to a-a' line in FIG. 1 (*b*). This fluid heating device is a device for controlling a temperature of sulfuric acid-based chemicals such as sulfuric acid, a mixed solution of sulfuric acid and aqueous hydrogen peroxide, or a mixed acid of sulfuric acid and nitric acid by heating it. The phrase "sulfuric acid-based chemicals" herein refers to chemicals containing 50% or more of sulfuric acid.

The structure of the fluid heating device will be explained below.

As shown in FIGS. 1 (*a*) and (*b*), the fluid heating device has an inner tube 3*a* composed of a cylindrical container, and a lamp heater 4 such as a cylindrical halogen lamp whose diameter is smaller than that of the inner tube 3*a* is coaxially inserted into the inside of the inner tube, as a heat source. In addition, the outside of the inner tube 3*a* is coaxially covered by a cylindrical outer tube 2 whose diameter is larger than that of the inner tube 3*a*. The inner tube 3*a* and the outer tube 2 are made of a translucent material such as quartz glass, and they are each connected to disc side plates 15*a* and 15*b* by welding, thereby forming an integral structure. The side plates 15*a* and 15*b* are made of a translucent material such as, for example, quartz glass.

A heat-insulating material (not shown in Figures) is disposed outside this outer tube 2, and the tube is covered by a plastic case (not shown in Figures) which is hardly deformed even at high temperatures, such as PP, PVC or PTFE. A space between the inner tube 3*a* and the outer tube 2 forms a passage for the sulfuric acid-based chemicals. An emission line 5 such as a halogen lamp is inserted in the inside of the lamp heater 4, light emitted from the emission line 5 penetrates through the inner tube 3*a*, and the chemicals are exposed to the light and is heated.

In a peripheral wall of the outer tube 2, an inlet 7 and an outlet 8 for the chemicals, located at the side of the side plate 15*a* are provided, and the inlet 7 is disposed at a lower part and the outlet 8 is disposed at an upper part.

A colored material which is not corroded by the chemicals, such as an amorphous carbon pipe 1, is disposed in a space between the inner tube 3*a* and the outer tube 2, and this amorphous carbon pipe 1 is fixed by engagement of a first passage partition member 6*a*, which is provided inside the outer tube 2 and on the side of the side plate 15*a*, and a second passage partition member 6*b*, which is provided outside the inner tube 3*a* and on the side of the side plate 15*b*. One or more through-holes 16 through which the chemicals passes are provided in the second passage partition member 6*b*. Furthermore, the inlet 7 is located between the first passage partition member 6*a* and the side plate 15*a*, and the outlet 8 is located between the first passage partition member 6*a* and the side plate 15*b*.

In this embodiment, the amorphous carbon pipe 1 is used as the colored material which is not corroded by the chemicals, but it is also possible to use, for example, a pipe composed of colored quartz glass including black one, foam glass, SiC, Teflon® or polyimide. In such a case, a design which considers the change in shape depending on the temperature variation is necessary since material data depend on the material to be used varies, like the amorphous carbon pipe having a coefficient of thermal expansion of 2 to $3.4\times10^{-6}/°$ C. and the quartz glass having a coefficient of thermal expansion of $5.5\times10^{-7}/°$ C.

The space between the inner tube 3*a* and the outer tube 2, the amorphous carbon pipe 1, and the first and the second passage partition members 6*a* and 6*b* form the passage for the chemicals as shown by arrows.

This passage for the chemicals will be explained in detail.

The chemicals which enters from the inlet 7 located at the lower end side of the outer tube 2 passes through a space between the side plate 15*a* and the first passage partition member 6*a*, and then passes through a space between the inner tube 3*a* and the amorphous carbon pipe 1, followed by the through-hole 16 in the second passage partition member 6*b*, and reaches the side plate 15*b* located on the other end side of the outer tube 2. The solution turns back and flows in the opposite direction, passes through a space between the outer tube 2 and the amorphous carbon pipe 1, and exits the outlet 8 located on the upper end side of the outer tube 2. By forming such a passage, the chemicals flow turbulently.

Next, a method for heating the chemicals will be explained.

Light emitted from the emission line 5 in the lamp heater 4 is transmitted through the inner tube 3*a*, and the chemicals which pass through the space between the inner tube 3*a* and the amorphous carbon pipe 1 is irradiated with the transmitted light, whereby the chemicals are radiation-heated. At this time, the amorphous carbon pipe 1 is irradiated with a part of the light transmitted through the chemicals without being utilized for the radiation-heating, whereby the amorphous carbon pipe 1 is heated and the chemicals that are in contact with the heated amorphous carbon pipe 1 are heated by the heat-conduction. That is, both of the chemicals which pass through the space between the outer tube 2 and the amorphous carbon pipe 1, and the chemicals which pass through the space between the inner tube 3*a* and the amorphous carbon pipe 1 are heated by the heat-conduction from the amorphous carbon pipe 1. The chemicals thus heated exit the outlet 8.

As stated above, according to the first embodiment of the present invention, the passage for the chemicals is formed by disposing the amorphous carbon pipe 1 between the inner tube 3*a* and the outer tube 2. Therefore, the flow rate of the chemicals can be increased and the flow can be made turbulent, and thus the convection-heating and the conduction-heating can be promoted. Particularly, when the sulfuric acid-based chemicals is used as the fluid, the heating efficiency can be more improved by the fluid heating device of this embodiment wherein light energy is absorbed in the amorphous carbon pipe 1 and converted into heat energy, and the chemicals are heated by the conduction-heating, than by conventional fluid heating devices wherein 30% to 40% light energy is absorbed in the heat-insulating material disposed outside the outer tube 2. Therefore, even in the sulfuric acid-based chemicals that have a low light absorption percent, the heating efficiency can be maximized, the temperature increase of the case of the fluid heating device can be suppressed, and the chemicals can also easily reach the desired temperature.

Furthermore, the risk of leakage of the chemicals can be reduced by connecting each of the inner tube 3*a* and the outer tube 2 to the disc side plates 15*a* and 15*b* by welding to thereby form an integral structure.

Figure 2:
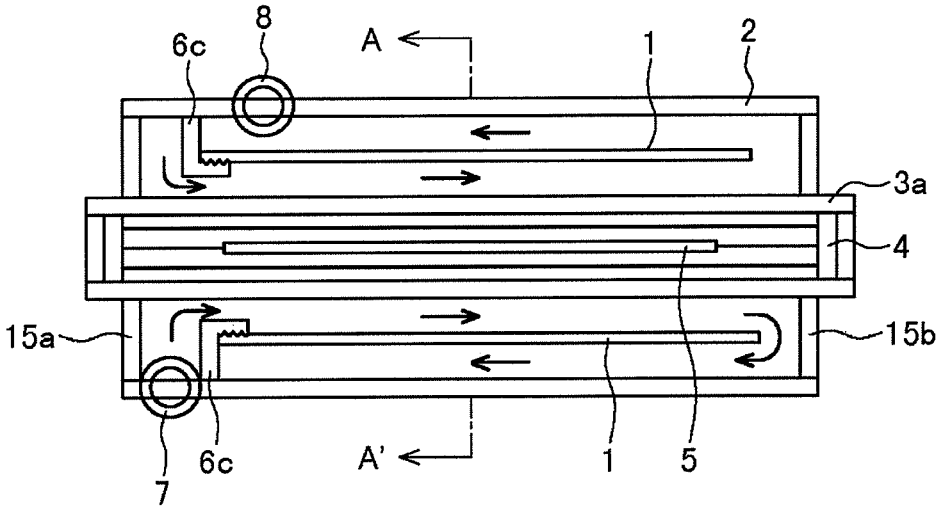
FIG. 2 A schematic view showing a longitudinal section of a fluid heating device according to a second embodiment.

FIG. 2 is a schematic view showing a longitudinal section of a fluid heating device according to a second embodiment of the present invention, in which the same reference numerals are given to the same parts as in FIG. 1 (*a*), and only differing parts will be explained. It should be noted that FIG. 2 is a longitudinal cross-sectional view corresponding to a-a' line in FIG. 1 (*b*).

A third passage partition member 6*c*, which is disposed inside an outer tube 2 and on the side of a side plate 15*a*, is provided with a screw thread. Furthermore, a screw thread is formed at one end of an amorphous carbon pipe 1, which is disposed in a space between an inner tube 3*a* and the outer tube 2. The amorphous carbon pipe 1 is fixed between the inner tube 3*a* and the outer tube 2 by screwing the one end of the amorphous carbon pipe 1 on the third passage partition member 6*c*.

It should be noted that the screw threads formed on the third passage partition member 6*c* and the one end of the amorphous carbon pipe 1 may be an internal thread type in which the amorphous carbon pipe 1 is fixed inside the member, or an external thread type in which the amorphous carbon pipe 1 is fixed outside the member.

As stated above, in the second embodiment of the present invention, the same effects as those obtained in the first embodiment can also be obtained.

Figure 3:
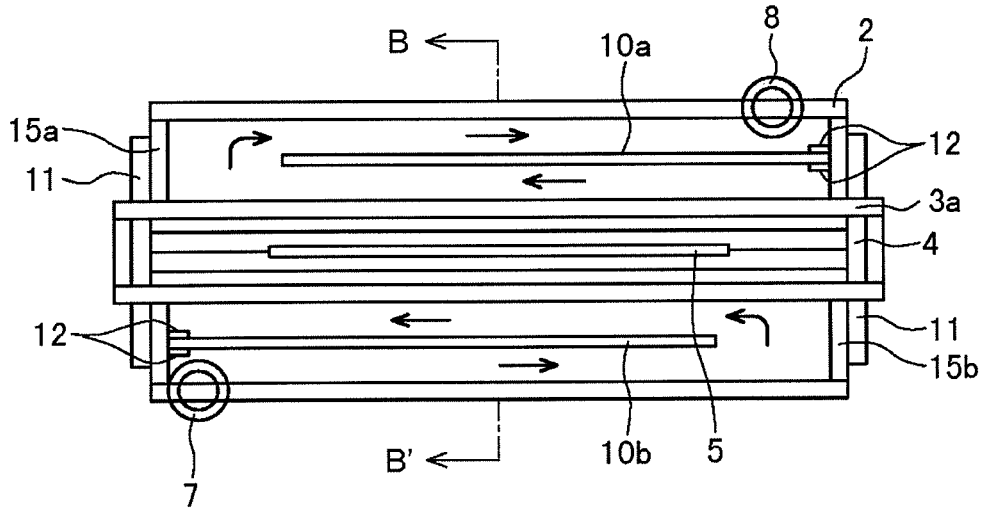
FIG. 3 (*a*) is a schematic view showing a longitudinal section of a fluid heating device according to a third embodiment of the present invention; and (*b*) is a cross-sectional view corresponding to B-B' line in FIG. 3 (*a*).
Figure 3:
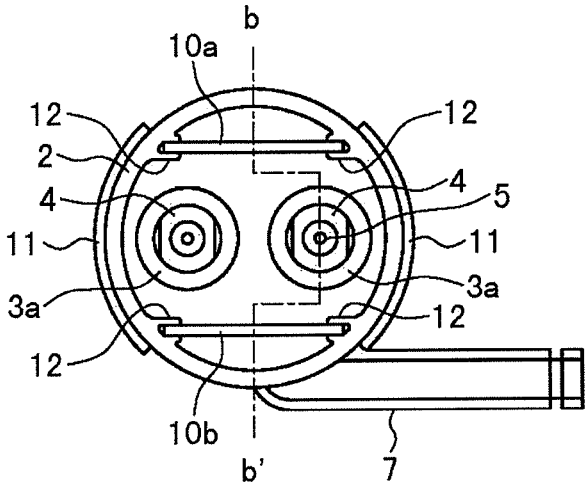

FIG. 3 (*a*) shows schematic views showing longitudinal cross-sections of a fluid heating device according to a third embodiment of the present invention, in which FIG. 3 (*b*) is a cross-sectional view corresponding to B-B' line in FIG. 3 (*a*), and FIG. 3 (*a*) is a longitudinal cross-sectional view corresponding to b-b' line in FIG. 3 (*b*). It should be noted that, in FIG. 3, the same reference numerals are given to the same parts as in FIG. 1, and the explanation thereof will be omitted.

As shown in FIGS. 3 (*a*) and (*b*), the fluid heating device has two inner tubes 3*a*, and a lamp heater 4 is inserted into each of the two inner tubes 3*a*. Amorphous carbon plates 10*a* and 10*b*, which are composed of a colored material that is not corroded by chemicals, are disposed inside an outer tube 2 and on the upper and lower sides of the two inner tubes 3*a*.

A fixing member 12 is provided inside the side plate 15*a* and inside the outer tube 2, and the lower amorphous carbon plate 10*b* is fixed by the fixing member 12. Furthermore, a fixing member 12 is provided inside the side plate 15*b* and inside the outer tube 2, and the upper amorphous carbon plate 10*a* disposed is fixed by the fixing member 12.

An inlet 7 for fluid is provided on a lower surrounding wall of the outer tube 2 located on the side of the side plate 15*a*, and an outlet 8 for fluid is provided on an upper surrounding wall of the outer tube 2 located on the side of the side plate 15*b*.

As shown in FIG. 3 (*b*), the amorphous carbon plates 10*a* and 10*b* are disposed in parallel across the lamp heaters 4, and thus there are sites where light emitting from the lamp heater 4 reaches the outer tube 2 without interruption of the amorphous carbon plates. Light reflecting plates 11 are provided on the sites, which are on the outer tube 2 and on the outsides of the side plates 15*a* and 15*b*. Due to this structure, light emitting from the lamp heater 4 is reflected by the light reflecting plates 11, and the reflected light is absorbed in the amorphous carbon plates 10*a* and 10*b* and converted into heat energy.

The space between the inner tube 3*a* and the outer tube 2, and the amorphous carbon plates 10*a* and 10*b* forms a passage for the chemicals as shown by arrows in FIG. 3 (*a*).

This passage for the chemicals will be explained in detail.

The chemicals which enters from the inlet 7 located on the lower end side of the outer tube 2 passes through a space between the outer tube 2 and the lower amorphous carbon plate 10*b*, and reaches the side plate 15*b* located on the opposite end side of the outer tube 2. The solution turns backs and flows in the opposite direction, passes through a space between the lower amorphous carbon plate 10*b* and the upper amorphous carbon plate 10*a*, and reaches the side plate 15*a* located on the one end side of the outer tube 2. The solution turns back and flows in the opposite direction, passes through a space between the outer tube 2 and the upper amorphous carbon plate 10*a*, and exits the outlet 8 located on the upper end side of the outer tube 2. When such a passage is formed, the chemicals flow turbulently.

Next, a method for heating the chemicals will be explained.

Light emitted from the emission line 5 in the lamp heater 4 is transmitted through the inner tubes 3*b*, and the chemicals which pass through the space between the upper amorphous carbon plate 10*a* and the lower amorphous carbon plate 10*b*, whereby the chemicals are radiation-heated. At this time, the amorphous carbon plates 10*a* and 10*b* are irradiated with a part of the light which is transmitted through the chemicals without being utilized for the radiation-heating, and the reflected light which is reflected by the light reflecting plates 11 is absorbed in the amorphous carbon plates 10*a* and 10*b*. This heats the amorphous carbon plates 10*a* and 10*b*, and the chemicals which are brought into contact with the heated amorphous carbon plates 10*a* and 10*b* are heated by the heat-conduction. That is, both of the chemicals which pass through the space between the outer tube 2 and each of the amorphous carbon plates 10*a* and 10*b*, and chemicals which pass through the space between the upper amorphous carbon plate 10*a* and the lower amorphous carbon plate 10*b*, are heated by the heat-conduction from the amorphous carbon plates 10*a* and 10*b*. The chemicals thus heated exit the outlet 8.

As stated above, in the third embodiment of the present invention, the same effects as those obtained in the first embodiment can also be obtained. In addition, when the amorphous carbon plates 10*a* and 10*b*, and the light reflecting plates 11 are provided, the light emitted from the lamp heater 4 is reflected by the light reflecting plates 11, and the reflected light is converted into heat energy by the amorphous carbon plates 10*a* and 10*b*. This enables the fluid to be heated by the convection and the heat-conduction, in addition of the radiation-heating by the lamp heater 4.

Figure 4:
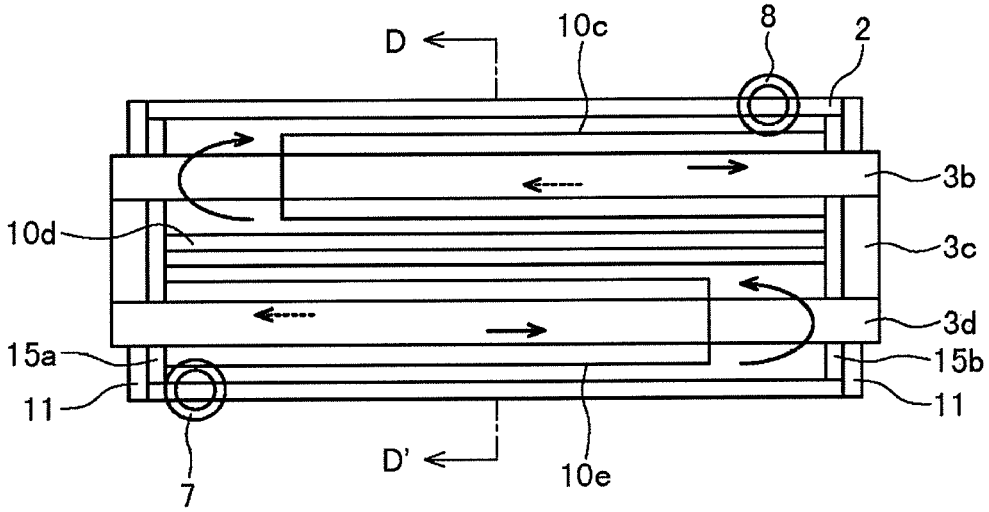
FIG. 4 (*a*) is a schematic view showing a longitudinal section of a fluid heating device according to a fourth embodiment of the present invention; and (*b*) is a cross-sectional view corresponding to D-D' line in FIG. 4 (*a*).
Figure 4:
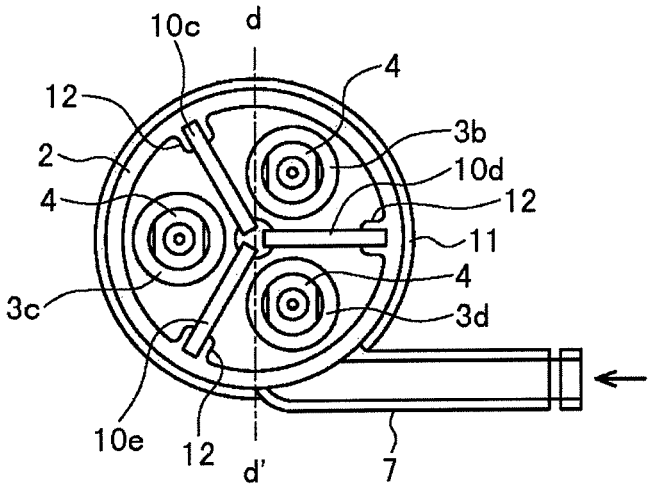

FIG. 4(*a*) is schematic views showing longitudinal sections of a fluid heating device according to a fourth embodiment of the present invention, in which FIG. 4(*b*) is a cross-sectional view corresponding to D-D' line in FIG. 4(*a*), and FIG. 4(*a*) is a longitudinal section view corresponding to d-d' line in FIG. 4(*b*). It should be noted that, in FIG. 4, the same numerals are given to the same parts as in FIG. 1, and the explanation thereof will be omitted.

As shown in FIGS. 4 (*a*) and (*b*), the fluid heating device has three inner tubes 3*b*, 3*c* and 3*d*, and a lamp heater 4 is inserted into each of the inner tubes 3*b*, 3*c* and 3*d*. Amorphous carbon plates 10*c*, 10*d* and 10*e* are disposed, which separate the inner tubes 3*b*, 3*c* and 3*d* from each another, in an outer tube 2. Each of the amorphous carbon plates 10*c*, 10*d* and 10*e* is fixed by a fixing member 12 which is provided inside the outer tube 2, fixing members which are provided on side plates 15*a* and 15*b*, respectively, and a central axis member 12*a* which is disposed on the central axis of the outer tube 2.

Particularly, as shown in FIG. 4 (*a*), the amorphous carbon plate 10*e*, which is located on the lower side in the view, is fixed to the side plate 15*a* and the inside of the outer tube 2; the amorphous carbon plate 10*c* which is located on the upper side in the view is fixed to the side plate 15*b* and the inside of the outer tube 2; and the amorphous carbon plate 10*d* which is located at the center in the view is fixed to the side plates 15*a* and 15*b*, and the inside of the outer tube 2 across from the side plate 15*a* to the side plate 15*b*.

An inlet 7 for fluid is provided on a lower surrounding wall of the outer tube 2 which is located on the side of the side plate 15*a*, and an outlet 8 for fluid is provided on an upper surrounding wall of the outer tube 2 which is located on the side of the side plate 15*b*.

In addition, as shown in FIG. 4 (*b*), there are sites where light emitting from the lamp heater 4 reaches the outer tube 2 without interruption of the amorphous carbon plates 10*c*, 10*d* and 10*e*. Light reflecting plates 11 are provided on the sites, which are on the outer tube 2 and outside the side plates 15*a* and 15*b*. Due to this structure, light emitting from the lamp heater 4 is reflected by the light reflecting plates 11, and the reflected light is absorbed in the amorphous carbon plates 10*c*, 10*d* and 10*e* and converted into heat energy.

The space between the inner tube 3*a* and the outer tube 2, and the amorphous carbon plates 10*c*, 10*d* and 10*e* forms a passage for the chemicals as shown by arrows in FIG. 4 (*a*).

This passage for the chemicals will be explained in detail.

The chemicals which enters from the inlet 7 located on the lower end side of the outer tube 2 passes through a space formed by the outer tube 2 and the amorphous carbon plates 10*d* and 10*e*, and reaches the side plate 15*b* located on the opposite end side of the outer tube 2. The solution turns back and flows in the opposite direction, passes through a space formed by the outer tube 2 and the amorphous carbon plates 10*c* and 10*e*, and reaches the side plate 15*a* located on the one end side of the outer tube 2. The solution turns back and flows in the opposite direction, passes through a space formed by the outer tube 2 and the amorphous carbon plates 10*c* and 10*d*, and exits the outlet 8 located on the upper end side of the outer tube 2. When such a passage is formed, the chemicals flow turbulently.

Next, a method for heating the chemicals will be explained.

Light emitted from the emission line 5 in the lamp heater 4 is transmitted through the inner tubes 3*b*, 3*c* and 3*d*, and the chemicals which pass through the inside of the tube 2 is irradiated with the transmitted light, whereby the chemicals are radiation-heated. At this time, the amorphous carbon plates 10*c*, 10*a* and 10*b* are irradiated with a part of the light which is transmitted through the chemicals without being utilized for the radiation-heating, and the reflected light which is reflected by the light reflecting plates 11 is absorbed in the amorphous carbon plates 10*c*, 10*d* and 10*e*. This heats the amorphous carbon plates 10*c*, 10*d* and 10*e*, and the chemicals which are brought into contact with the heated amorphous carbon plates 10*c*, 10*d* and 10*e* is heated by the heat-conduction. The chemicals thus heated exits the outlet 8.

As stated above, in the fourth embodiment of the present invention, the same effects as those obtained in the first embodiment can also be obtained.

Figure 5:
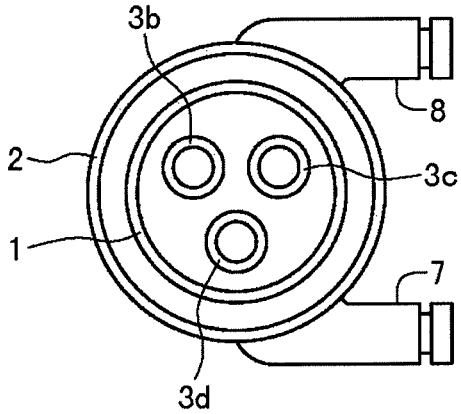
FIG. 5 A schematic view showing a cross section of a fluid heating device according to a fifth embodiment of the present invention.

FIG. 5 is a schematic view showing a cross section of a fluid heating device according to a fifth embodiment of the present invention, in which the same numerals are given to the same parts as in FIG. 1 (*b*), and only differing parts will be explained.

Three inner tubes 3*b* to 3*d* are disposed in an amorphous carbon pipe 1 in an outer tube 2, and a lamp heater is inserted into each of these inner tubes 3*b* to 3*d*.

A passage for chemicals will be explained in detail.

The chemicals which enter from an inlet 7 located on a lower end side of the outer tube 2 pass through a space between a side plate and a first passage partition member, then a space between the inner tubes 3*b* to 3*d* and an amorphous carbon pipe 1, followed by through-holes in a second passage partition member, and reach a side plate located on the opposite end side of the outer tube 2. The solution turns back and flows in the opposite direction, passes through a space between the outer tube 2 and the amorphous carbon pipe 1, and exits an outlet 8 located on an upper end side of the outer tube 2. When such a passage is formed, the chemicals flow turbulently.

In the fifth embodiment, the same effects as those obtained in the first embodiment can also be obtained.

Figure 6:
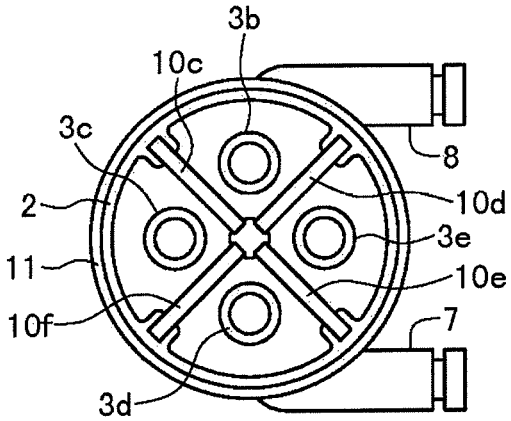
FIG. 6 A schematic view showing a cross section of a fluid heating device according to a sixth embodiment of the present invention.

FIG. 6 is a schematic view showing a cross section of a fluid heating device according to a sixth embodiment of the present invention, in which the same numerals are given to the same parts as in FIG. 4 (*b*), and the explanation thereof will be omitted.

The two devices are different from each other in that in the fluid heating device shown in FIG. 4 (*b*), the three inner tubes 3*b* to 3*d* are disposed inside the outer tube 2, but in the fluid heating device shown in FIG. 6, four inner tubes 3*b* to 3*e* are disposed inside of the outer tube 2. With the setting up of the four inner tubes 3*b* to 3*e*, a passage for the chemicals is formed by four amorphous carbon plates 10*c* to 10*f*.

This passage for the chemicals will be explained in detail.

The chemicals which enter from an inlet 7 located on a lower end side of the outer tube 2 passes through a space formed by the outer tube 2 and amorphous carbon plates 10*f* and 10*e*, and reaches a side plate 15*b* located on the opposite end side of the outer tube 2. The solution turns back and flows in the opposite direction, passes through a space formed by the outer tube 2 and the amorphous carbon plates 10*e* and 10*d*, and a space formed by the outer tube 2 and amorphous carbon plates 10*f* and 10*c*, and reaches the outer tube 2. The solution turns back and flows in the opposite direction, passes through a space formed by the outer tube 2 and the amorphous carbon plates 10*d* and 10*c*, reaches a side plate 15*b* located on the opposite end side of the outer tube 2, and exits an outlet 8 located on an upper end side of the outer tube 2. When such a passage is formed, the chemicals flow turbulently.

In the sixth embodiment, the same effects as those obtained in the fourth embodiment can also be obtained.

Figure 7:
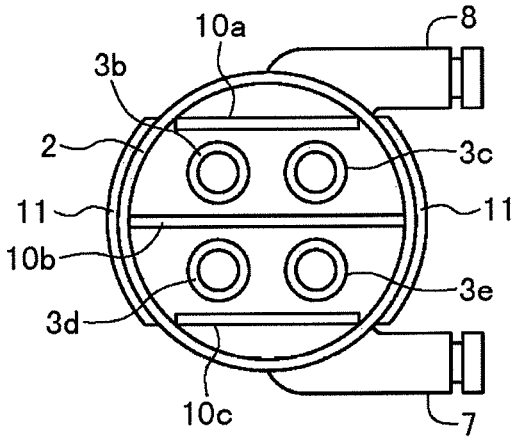
FIG. 7 A schematic view showing a cross section of a fluid heating device according to a seventh embodiment of the present invention.

FIG. 7 is a schematic view showing a cross section of a fluid heating device according to a seventh embodiment of the present invention, in which the same reference numerals are given to the same parts as in FIG. 3 (*b*), and only differing parts will be explained.

The both devices are different from each other in that in the fluid heating device shown in FIG. 3 (*b*), the two inner tubes 3*a* are disposed inside of the outer tube 2, but in a fluid heating device shown in FIG. 7, four inner tubes 3*b* to 3*e* are disposed inside an outer tube 2. With the setting-up of the four inner tubes 3*b* to 3*e*, a passage for the chemicals is formed by three amorphous carbon plates 10*a* to 10*c*

This passage for the chemicals will be explained in detail.

The chemicals which enter from an inlet 7 located on a lower end side of the outer tube 2 passes through a space between the outer tube 2 and a lower amorphous carbon plate 10*c*, and reaches a side plate 15*b* located on the opposite end side of the outer tube 2. The solution turns back and flows in the opposite direction, passes through a space between the lower amorphous carbon plate 10*c* and a central amorphous carbon plate 10*b*, and reaches a side plate 15*a* located on one end side of the outer tube 2. Then, the solution turns back and flows in the opposite direction again, passes through a space between the central amorphous carbon plate 10*b* and an upper amorphous carbon plate 10*a*, and reaches a side plate 15*b* located on the opposite end side of the outer tube 2. Then, the solution turns back and flows in the opposite direction, passes through a space between the outer tube 2 and the upper amorphous carbon plate 10*a*, and exits an outlet 8 located on an upper end side of the outer tube 2. By forming such a passage, the chemicals flow turbulently.

In the seventh embodiment, the same effects as those obtained in the third embodiment can also be obtained.

Figure 8:
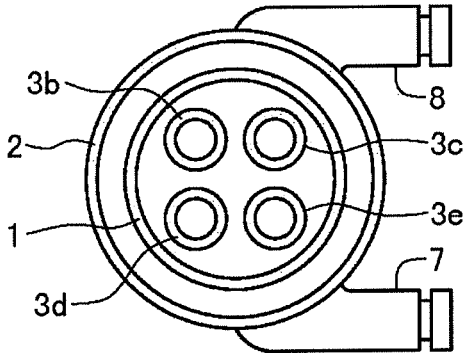
FIG. 8 A schematic view showing a cross section of a fluid heating device according to an eighth embodiment of the present invention.

FIG. 8 is a schematic view showing a cross section of a fluid heating device according to an eighth embodiment of the present invention, in which the same reference numerals are given to the same parts as in FIG. 1 (*b*), and only differing parts will be explained.

Four inner tubes 3*b* to 3*e* are disposed inside an amorphous carbon pipe 1 in an outer tube 2. A lamp heater is inserted into each of these inner tubes 3*b* to 3*e*.

A passage for the chemicals will be explained in detail.

The chemicals which enter from an inlet 7 located on a lower end side of the outer tube 2 passes through a space between a side plate and a first passage partition member, then a space between inner tubes 3*b* to 3*e* and an amorphous carbon pipe 1, followed by through-holes in a second passage partition member, and reaches a side plate located on the opposite end side of the outer tube 2. Then, the solution turns back and flows in the opposite direction, passes through a space between the outer tube 2 and the amorphous carbon pipe 1, and exits an outlet 8 located on an upper end side of the outer tube 2. By forming such a passage, the chemicals flow turbulently.

In the eighth embodiment, the same effects as those obtained in the first embodiment can also be obtained.

The present invention is not limited to the embodiments described above, and various modifications can be carried out within the range not departing from the inventive concepts.

EXPLANATION OF REFERENCE NUMERALS

1: amorphous carbon pipe
2: outer tube
3*a*, 3*b*, 3*c*, 3*d* and 3*e*: inner tubes
4: lamp heater
5: emission line
6*a*: first passage partition member
6*b*: second passage partition member
6*c*: third passage partition member
7: fluid inlet
8: fluid outlet
10*a*, 10*b*, 10*c*, 10*d*, 10*e* and 10*f*: amorphous carbon plates
11: light reflecting plate
12: fixing member
15*a* and 15*b*: side plates
16: through-hole

The invention claimed is:

1. A fluid heating device for heating sulfuric acid-based chemicals, comprising:

a translucent inner tube;

a lamp heater disposed in the inner tube;

a translucent outer tube disposed outside the inner tube;

translucent side plates disposed on both sides of the outer tube; and a light-absorbing body disposed between the outer tube and the inner tube, wherein the light-absorbing body is disposed so as to be in contact with chemicals passing through a space between the outer tube and the inner tube, wherein the light-absorbing body has a tubular shape covering the inner tube, wherein the light-absorbing body forms a passage for the chemicals passing through the space between the outer tube and the inner tube, wherein a direction of flow of the chemicals in contact with an inner surface of the outer tube is opposite to a direction of flow of the chemicals in contact with an outer surface of the inner tube, wherein the entire surface of the light-absorbing body is in contact with the chemicals wherein a direction of flow of the chemicals in contact with an outer surface of the light-absorbing body is opposite to a direction of flow of the chemicals in contact with an inner surface of the light-absorbing body, and wherein the light-absorbing body is positioned to shield the outer tube from the lamp heater.

2. The fluid heating device according to claim 1, wherein each of the inner tube, the outer tube and the side plate includes quartz, and wherein the inner tube and the outer tube are connected to the side plates, respectively, by welding so that they are integrally formed.

* * * * *